US008003901B2

(12) United States Patent
Sugimoto et al.

(10) Patent No.: US 8,003,901 B2
(45) Date of Patent: Aug. 23, 2011

(54) SWITCH DEVICE

(75) Inventors: Satoshi Sugimoto, Aichi (JP); Katsutoshi Terakawa, Aichi (JP); Makoto Kobayashi, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 519 days.

(21) Appl. No.: 11/795,848

(22) PCT Filed: Jan. 24, 2006

(86) PCT No.: PCT/JP2006/001383

§ 371 (c)(1),
(2), (4) Date: Jul. 23, 2007

(87) PCT Pub. No.: WO2006/078075

PCT Pub. Date: Jul. 27, 2006

(65) Prior Publication Data

US 2008/0135393 A1 Jun. 12, 2008

(30) Foreign Application Priority Data

Jan. 24, 2005 (JP) ..... P.2005-015640

(51) Int. Cl.
*H01H 3/00* (2006.01)

(52) U.S. Cl. ..... 200/5 E; 200/5 R; 200/341

(58) Field of Classification Search ..... 200/1 B, 200/4, 5 R, 6 A, 6 R, 17 R, 18, 339, 517, 200/553

See application file for complete search history.

(56) References Cited

U.S. PATENT DOCUMENTS

| | | | | |
|---|---|---|---|---|
| 5,115,108 | A * | 5/1992 | Ogawa et al. | 200/1 B |
| 6,201,202 | B1 * | 3/2001 | Katagiri | 200/513 |
| 6,737,592 | B1 * | 5/2004 | Hoang et al. | 200/1 B |
| 6,914,202 | B2 * | 7/2005 | Sugimoto et al. | 200/1 B |
| 2004/0074747 | A1 | 4/2004 | Komatsu et al. | 200/176 |
| 2004/0188235 | A1 * | 9/2004 | Sugimoto et al. | 200/339 |

FOREIGN PATENT DOCUMENTS

| | | |
|---|---|---|
| JP | 5-087777 U | 11/1993 |
| JP | 6-215665 A | 8/1994 |

* cited by examiner

*Primary Examiner* — Renee Luebke
*Assistant Examiner* — Marina Fishman
(74) *Attorney, Agent, or Firm* — Morgan, Lewis & Bockius LLP

(57) ABSTRACT

When a knob is operated, operating force is exerted on an operating point $P_m$ of the manual switch and an operating point $P_o$ of the automatic switch from a pusher, and thus the manual switch and the automatic switch are pushed and turned on sequentially. In this case, since the height H of the pusher is set '0.9 times' or more of the distance $L_{mo}$ from the operating point $P_m$ of the manual switch to the operating point $P_o$ of the automatic switch, the pusher has a vertically long shape. As a result, the operating force of the knob is influenced by the friction when the automatic switch is pushed and turned on. Therefore, the manual switch and the automatic switch can be pushed and turned on sequentially while using the automatic switch having small self-holding force $F_o$.

3 Claims, 6 Drawing Sheets

| Lmo | Fo | H | H/Lmo |
|---|---|---|---|
| 20.5 | 7.72 | 2 | 0.1 |
| 20.5 | 7.49 | 4 | 0.2 |
| 20.5 | 7.26 | 6 | 0.3 |
| 20.5 | 7.04 | 8 | 0.4 |
| 20.5 | 6.81 | 10 | 0.5 |
| 20.5 | 6.59 | 12 | 0.6 |
| 20.5 | 6.36 | 14 | 0.7 |
| 20.5 | 6.13 | 16 | 0.8 |
| 20.5 | 5.91 | 18 | 0.9 |
| 20.5 | 5.68 | 20 | 1.0 |
| 20.5 | 5.50 | 21.6 | 1.1 |
| 20.5 | 5.23 | 24 | 1.2 |
| 20.5 | 5.00 | 26 | 1.3 |
| 20.5 | 4.78 | 28 | 1.4 |
| 20.5 | 4.55 | 30 | 1.5 |

Prior Art

SWITCH DEVICE

TECHNICAL FIELD

The present invention relates to a switch device that is used to operate a power widow of an automobile.

BACKGROUND ART

FIG. 6 shows the configuration of a switch device in the related art. In the switch device, a manual switch 31 and an automatic switch 32 include a rubber contact point, respectively, and a pusher 33 is placed on the manual switch 31 and the automatic switch 32. A knob 34 is mounted on the pusher 33 and can pivot on a shaft 35. When an operator operates the knob 34, an operating portion 36 of the knob 34 pushes the upper surface of the pusher 33. Then, operating force is transferred from the pusher 33 to the manual switch 31 and the automatic switch 32, and the manual switch 31 is pushed and turned on preferentially. After that, when the manual switch 31 remains in ON state, the automatic switch 32 is pushed and turned on.

Patent Document 1: JP-A-6-215665

DISCLOSURE OF THE INVENTION

Problems to be Solved by the Invention

In the configuration of the switch device in the related art, the height H of the pusher 33 is set to be about '0.13 times' of the distance $L_{mo}$ between an operating point $P_m$ of the manual switch 31 and an operating point $P_o$ of the automatic switch 32. Therefore, when the manual switch 31 and the automatic switch 32 are pushed and turned on sequentially, the self-holding force $F_o$ of the automatic switch 32 increases and thus the cost of the automatic switch 32 tends to rise.

The invention has been invented in view of the problems inherent to the switch device in the related art, and it is an advantage of an aspect of the invention to provide a switch device capable of pushing the manual switch and the automatic switch sequentially for turning them on while the self-holding force of the automatic switch is small.

Means for Solving the Problems

A switch device according to a first aspect of the invention includes:

a push-type manual switch that is to be pushed against self-holding force to an ON state, the self-holding force being set to have a relatively large value;

a push-type automatic switch that is to be pushed against the self-holding force to an ON state, the self-holding force being set to have a relatively small value smaller than the relatively large value;

a switch substrate that outputs manual signals for operating a power window of a vehicle to move as long as the manual switch remains in the ON state on the basis of the operation of the manual switch in the ON state, and outputs automatic signals for operating the power window to move to an allowable position on the basis of the operation of the automatic switch in the ON state;

a knob that can be operated by a user; and a pusher that pushes the manual switch and the automatic switch sequentially by operating force applied from the knob, wherein a height of the pusher is set to be 0.9 times or more of a distance between an operating point of pushing force exerted on the manual switch from the pusher and an operating point of pushing force exerted on the automatic switch from the pusher.

According to a second aspect of the invention, the knob transfers the operating force to the pusher at a location closer to the manual switch side with respect to a center point of a segment connecting the operating point of pushing force exerted on the manual switch from the pusher and the operating point of pushing force exerted on the automatic switch from the pusher.

Effects of the Invention

When a knob is operated, operating force is transferred from a pusher to an operating point of a manual switch and an operating point of an automatic switch. In addition, the manual switch is pushed and turned on preferentially, and then the automatic switch is pushed and turned on in succession to the manual switch. In this case, since the height of the pusher is set to be 0.9 times or more of the distance between the operating point of the manual switch and an operating point of the automatic switch 32, the height of the pusher is relatively high. As a result, when the automatic switch is pushed, the operating force of the knob is considerably influenced by friction, therefore, it is possible to push and turn on the manual switch and the automatic switch sequentially while using the automatic switch having small self-holding force.

BEST MODE FOR CARRYING OUT THE INVENTION

An embodiment according to the present invention will be described with reference to accompanying drawings.

Figure 1:
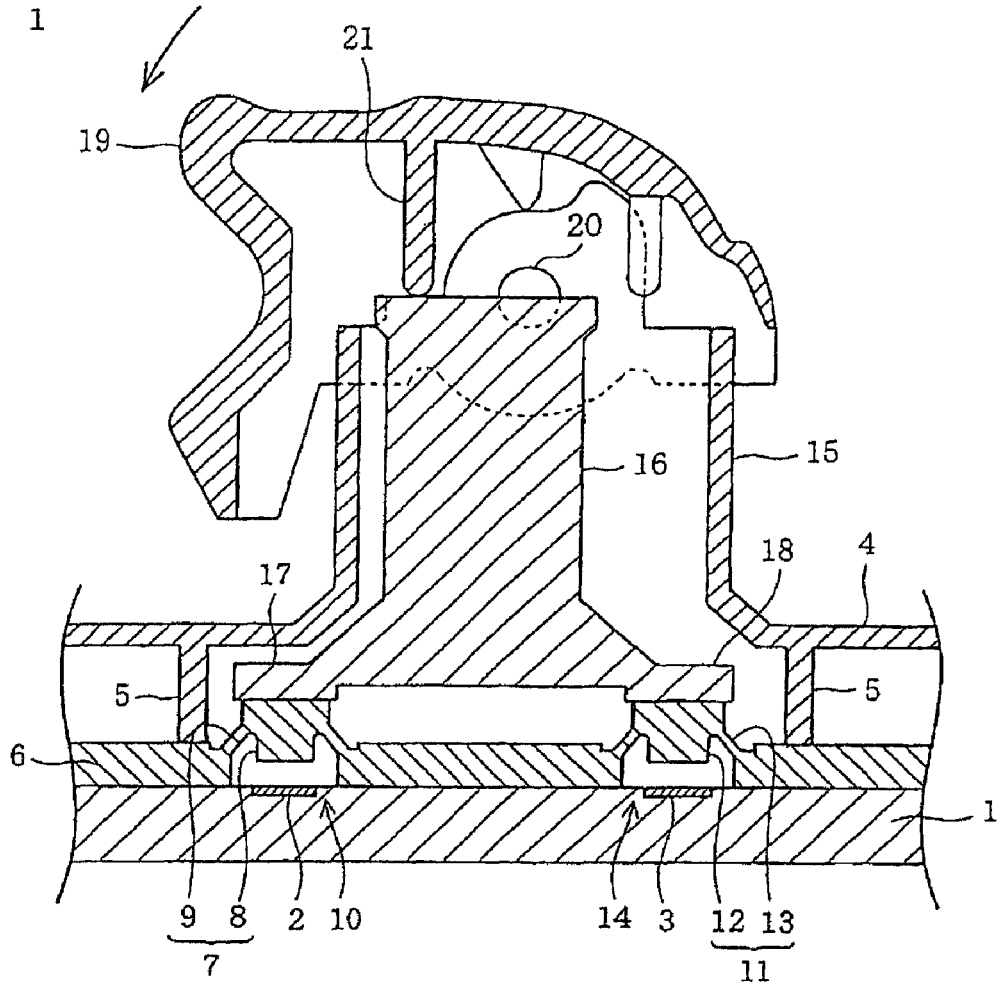
FIG. 1 is a view showing a cross-sectional view of the internal configuration of a switch device when a manual switch and an automatic switch are in the OFF state according to an embodiment of the invention.

A switch substrate 1 comprises a printed circuit board, and a fixed manual contact point 2 and a fixed automatic contact point 3 are formed on the wiring pattern of the switch substrate 1 as shown in FIG. 1. A switch case 4 is fixed on the switch substrate 1 and includes a plurality of leg parts 5. A sheet-shape holder base 6 is interposed between the plurality of leg parts 5 and the switch substrate 1. The holder base 6 is made of conductive rubber and fixed between the plurality of leg parts 5 and the switch substrate 1, not so as to deviate.

The holder base 6 includes a movable manual contact point 7, which is integrally formed therewith as a rubber contact point. The movable manual contact point 7 includes a contact point part 8 and a skirt part 9, and the contact point part 8 is coupled with the holder base 6 by the skirt part 9. The contact point part 8 and the skirt part 9 correspond to a relatively rigid body and a relatively elastic body, respectively. The contact point part 8 comes into contact with the fixed manual contact point 2 so as to turn a switch ON when the skirt part 9 is elastically deformed, and is separated from the fixed manual contact point 2 so as to turn the switch back to OFF when the skirt part 9 elastically returns due to the elastic force of the rubber. That is, the fixed manual contact point 2 and the movable manual contact point 7 constitute a push-type manual switch 10.

Figure 2:
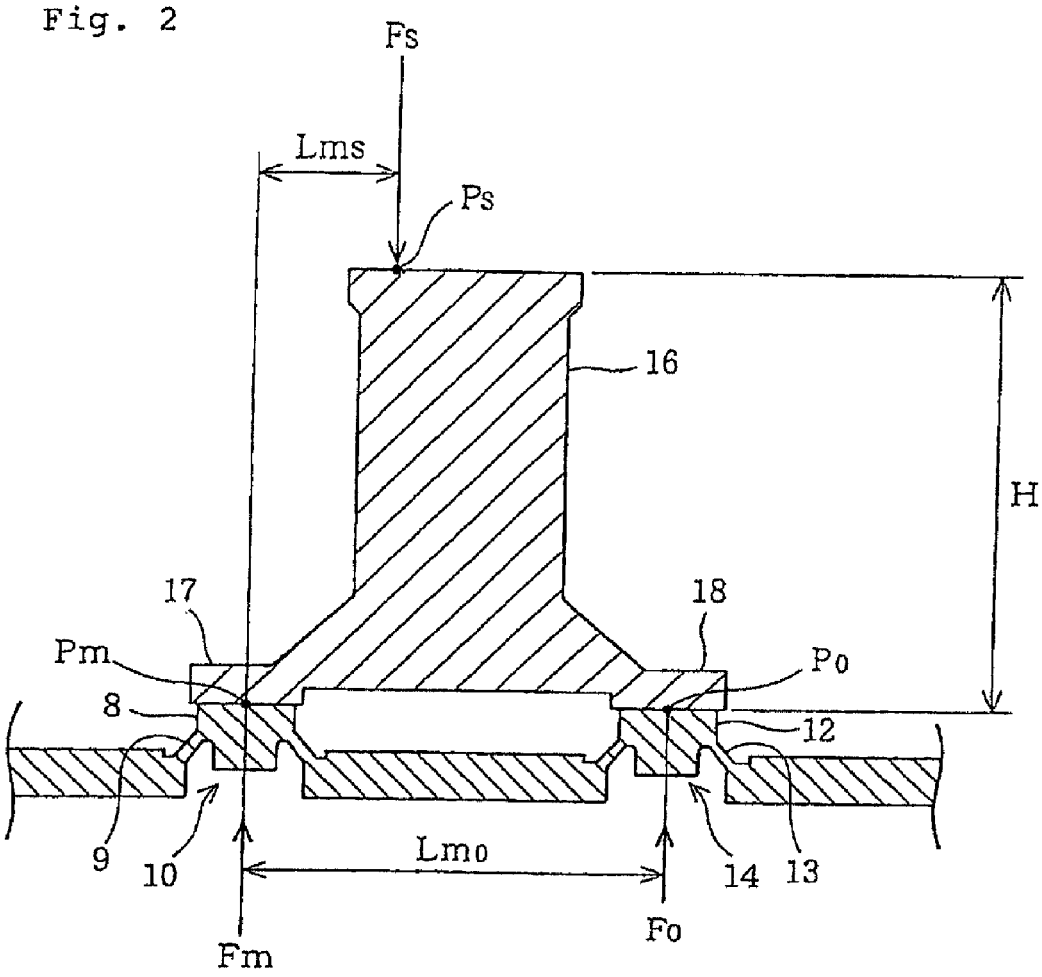
FIG. 2 is a view showing the arranging relationship among a pusher, the manual switch and the automatic switch when the manual switch and the automatic switch are in the OFF state.

The holder base 6 includes a movable automatic contact point 11, which is integrally formed therewith as a rubber contact point. The movable automatic contact point 11 includes a contact point part 12 acting as a relatively rigid body and a skirt part 13 acting as a relatively elastic body. The contact point part 12 comes into contact with the fixed automatic contact point 3 so as to turn the switch ON when the skirt part 13 is elastically deformed, and is separated from the fixed automatic contact point 3 so as to turn the switch back to OFF when the skirt part 13 elastically returns due to the elastic force of the rubber. The skirt part 13 of the movable automatic contact point 11 is thinner than the skirt part 9 of the movable manual contact point 7, and the self-holding force $F_o$ of the movable automatic contact point 11 is set to be smaller than the self-holding force $F_m$ of the movable manual contact point 7 as shown in FIG. 2. Meanwhile, the reference numeral 14 indicates a push-type automatic switch constituted by the fixed automatic contact point 3 and the movable automatic contact point 11.

The switch substrate 1 is connected to an ECU of an automobile, and outputs manual signals to the ECU when the manual switch 10 is in the ON state and outputs automatic signals when the automatic switch 14 is in the ON state. The ECU operates the power window of the automobile on the basis of the manual signals and the automatic signals transmitted from the switch substrate 1, that is, the ECU operates the power window as long as the manual signals are detected when only the manual signals are detected, and operates the power window to an allowable position regardless of the detecting period of the automatic signals when the automatic signals are detected.

The switch case 4 includes a tubular knob base 15 as shown in FIG. 1. The knob base 15 receives a pusher 16 therein, and the pusher 16 includes a manual pushing part 17 and an automatic pushing part 18. The pusher 16 has a vertically long shape, that is, the height H of the pusher 16 is set to be '0.9 times' or more of the distance $L_{mo}$ between the manual pushing part 17 and the automatic pushing part 18 as shown in FIG. 2. The manual pushing part 17 and the automatic pushing part 18 are supported by the movable manual contact point 7 and the movable automatic contact point 11, and thus the manual switch 10 and the automatic switch 14 are held in a normal state against the load of the pusher 16.

A knob 19 is mounted on the knob base 15 so as to pivot on a shaft 20 as shown in FIG. 1, and the manual switch 10 and the automatic switch 14 are disposed on a common straight line parallel to the pivoting direction of the knob 19. The knob 19 includes a perpendicular and plate-like operating part 21. The operating part 21 has a surface shape of circular arc and linearly contacts with an operating point $P_s$ on the upper surface of the pusher 16 as shown in FIG. 2. The operating point $P_s$ is set at a location closer to the manual switch 10 than the automatic switch 14 with respect to a center point of a segment connecting an operating point $P_m$ of pushing force, which is exerted on the contact point part 8 of the manual switch 10 from the manual pushing part 17 of the pusher 16, and an operating point $P_o$ of pushing force, which is exerted on the contact point part 12 of the automatic switch 14 from the automatic pushing part 18 of the pusher 16, and the knob 19 transfers the operating force to the pusher 16 at the operating point $P_S$.

If the knob 19 is operated in the direction of the arrow in FIG. 1 when the manual switch 10 and the automatic switch 14 are in the OFF state, the operating force is transferred to the pusher 16 via the operating part 21 of the knob 19, and thus the manual pushing part 17 and the automatic pushing part 18 of the pusher 16 push the manual switch 10 and the automatic switch 14. Then, the skirt part 9 of the manual switch 10 is elastically deformed, and thus the contact point part 8 comes into contact with the fixed manual contact point 2, thereby turning on the manual switch 10 preferentially. After that, while the manual switch 10 remains in the ON state, the skirt part 13 of the automatic switch 14 is elastically deformed, and thus the contact point part 12 comes into contact with the fixed automatic contact point 3, thereby turning on the automatic switch 14 in succession to the manual switch 10.

FIG. 2 shows the relationship among the manual switch 10, the automatic switch 14 and the pusher 16 when the manual switch 10 and the automatic switch 14 are in the OFF state. The conditions that the pusher 16 pivots on the operating point $P_s$ clockwise when the operating force $F_s$ is exerted on the operating point $P_s$ of the pusher 16 in the OFF state of the manual switch 10 and the automatic switch 14 are expressed as follows: Expressions (1) and (2).

$$L_{ms} \cdot F_s > L_{mo} \cdot F_o \tag{1}$$

$$F_m + F_o = F_s \tag{2}$$

Here, $F_s$ represents an operating force exerted on the pusher 16 from the knob 19, $L_{ms}$ represents the distance from the operating point $P_s$ of the pusher 16 to the operating point $P_m$ of the manual switch 10, and $L_{mo}$ represents the distance from the operating point $P_m$ of the manual switch 10 to the operating point $P_o$ of the automatic switch 14.

Expression (3) is obtained by inputting Expression (2) into Expression (1). Expression (3) expresses the condition that the pusher 16 pivots clockwise in FIG. 2 in conjunction with the operation of the knob 19, that is, the condition that the automatic switch 14 is operated in preference to the manual switch 10 by mistake. Expression (4) is obtained by changing Expression (3) and shows the relationship between '$L_{ms}/L_{mo}$' and '$F_m/F_o$'

$$L_{ms}/L_{mo} > F_o/(F_m + F_o) \tag{3}$$

$$F_m/F_o > \{1/(L_{ms}/L_{mo})\} - 1 \tag{4}$$

Figure 3:
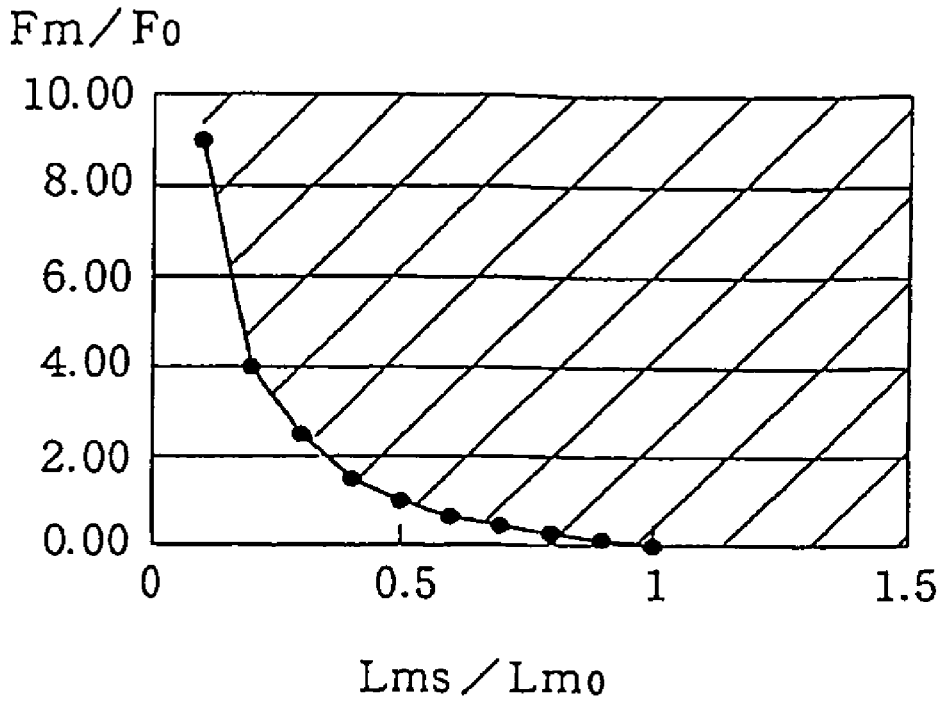
FIG. 3 is a view showing the relationship between the ratio of contact point load and the ratio of operating location.

FIG. 3 shows the graph of Expression (4). In FIG. 3, the hatched portion is the abnormal region, in which the automatic switch 14 is turned on preferentially, and the non-hatched portion is the normal region, in which the manual switch 10 is turned on preferentially. That is, when '$L_{ms}/L_{mo}$' is set smaller than '0.5', if '$F_m/F_o$' is set larger than '1', the manual switch 10 is turned on preferentially and thus the abnormal operation in which the automatic switch 14 is turned on preferentially does not occur.

Figure 4:
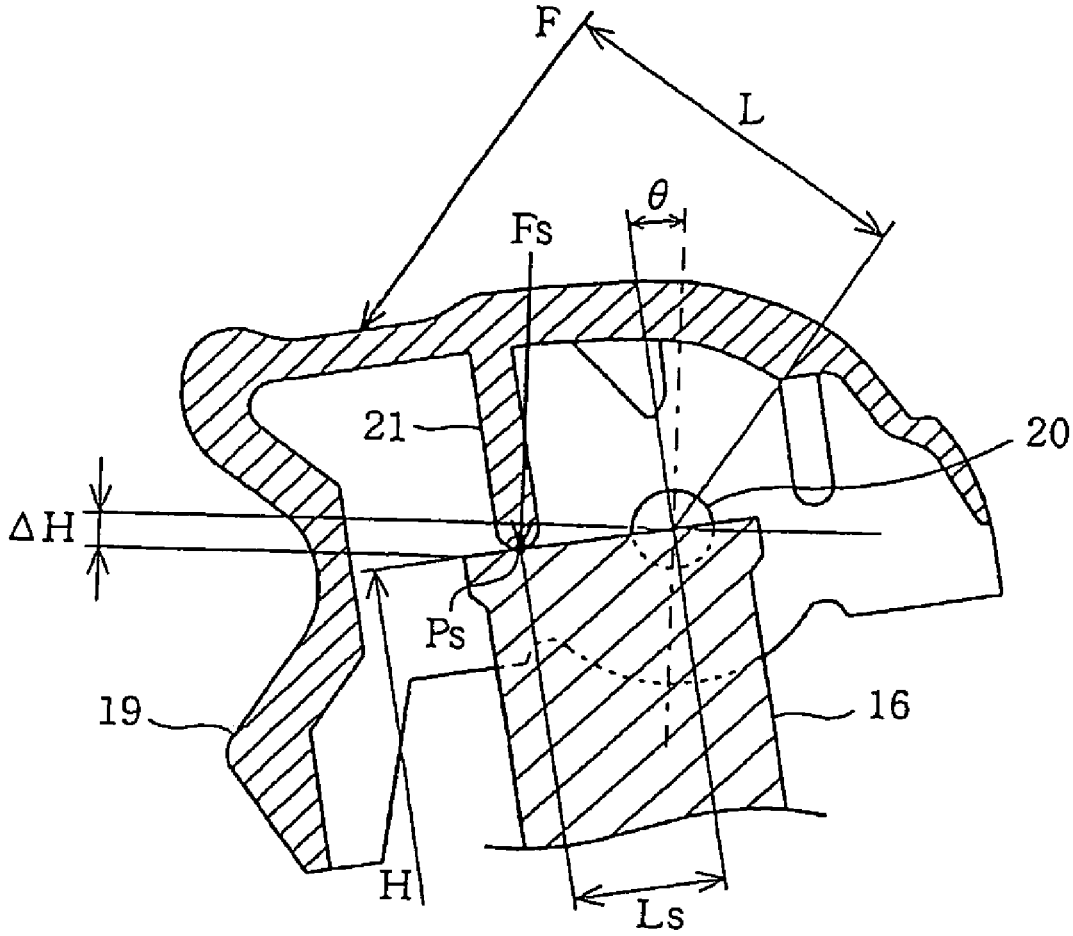
FIG. 4 is a view showing the relationship between the pusher and a knob when the manual switch alone is in the ON state.

FIG. 4 shows the relationship between the pusher 16 and the knob 19 when the manual switch 10 alone remains in the ON state, and Expression (5) shows the force balance between the pusher 16 and the knob 19 when the manual switch 10 alone remains in the ON state. Expression (5) is extracted without consideration of the influence of friction, and if the influence of friction is taken into account, Expression (6) is obtained. If specific values such as '$F_s$=5.8 N'·'θ=9.86°'·'ΔH=0.87 mm'·'L=15.77 mm'·'μ=0.1'·'F=8.52 N' are inputted to Expression (6), '$F_s$=23.1604' is obtained.

$$L_s \cdot F_s \cdot \cos\theta = F \cdot L \tag{5}$$

$$L_s \cdot F_s \cdot \cos\theta + \Delta H \cdot \mu \cdot F_s = F \cdot L \tag{6}$$

Here, $L_s$ represents the distance from the pivoting center of the knob 19 to the operating point $P_s$, F represents the operating force directly exerted on the knob 19, L represents the distance from the operating point of the operating force directly exerted on the knob 19 to the pivoting center of the knob 19, ΔH represents the vertical displacement of the pusher 16, and μ represents the coefficient of friction.

Expression (7) shows the force balance between the automatic switch 14 and the pusher 16 when the manual switch 10 alone remains in the ON state. Expression (7) is extracted without consideration of the influence of friction, and if the influence of friction is taken into account, Expression (8) is obtained. Expression (9) is obtained by changing Expression (8), and if specific values such as '$L_{ms}$=7.03 mm' and =0.1° are inputted to Expression (9), Expression (10) is obtained.

$$F_s \cdot L_{ms} = F_o \cdot L_{mo} \quad (7)$$

$$F_s \cdot (L_{ms} - H \cdot \mu) = F_o \cdot L_{mo} \quad (8)$$

$$F_s = F_o \cdot L_{mo} / (L_{ms} - H \cdot \mu) \quad (9)$$

$$F_s = F_o \cdot L_{mo} / (7.03 - 0.1 \cdot H) \quad (10)$$

Here, H represents the height of the pusher 16.

If '$F_s$=23.1604' is inputted to Expression (10), Expression (11) is obtained, and Expression (11) can be changed into Expression (12).

$$23.1604 = F_o \cdot L_{mo} / (\mathbf{7.03 - 0.1} \cdot H) \quad (11)$$

$$F_o = -2.316 \cdot H / L_{mo} + 162.82 / L_{mo} \quad (12)$$

Figures 5A, 5B:
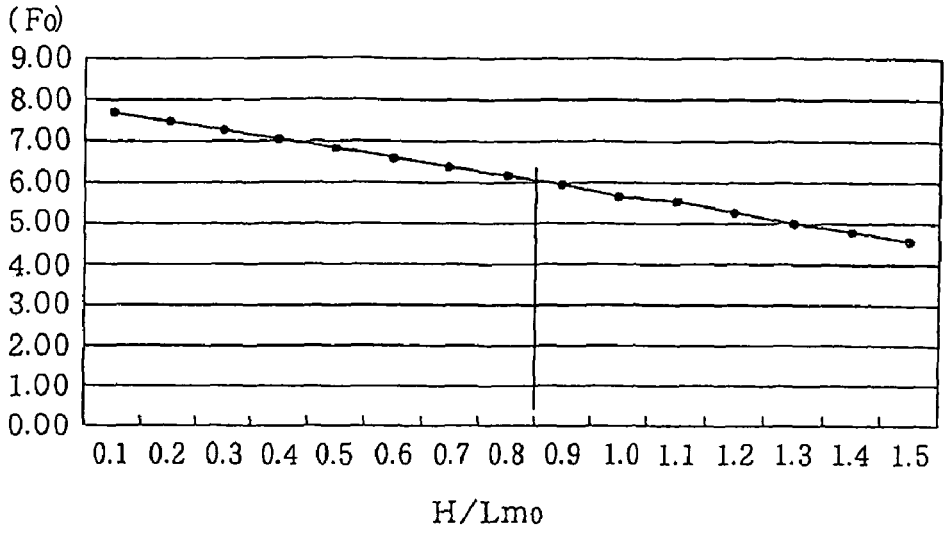
FIG. 5A is a view plotting the ratio of the distance from the manual switch to the automatic switch to the height of the pusher with respect to the contact point load of the automatic switch.
FIG. 5B is a view showing data necessary to plot FIG. 5A.
Figure 6:
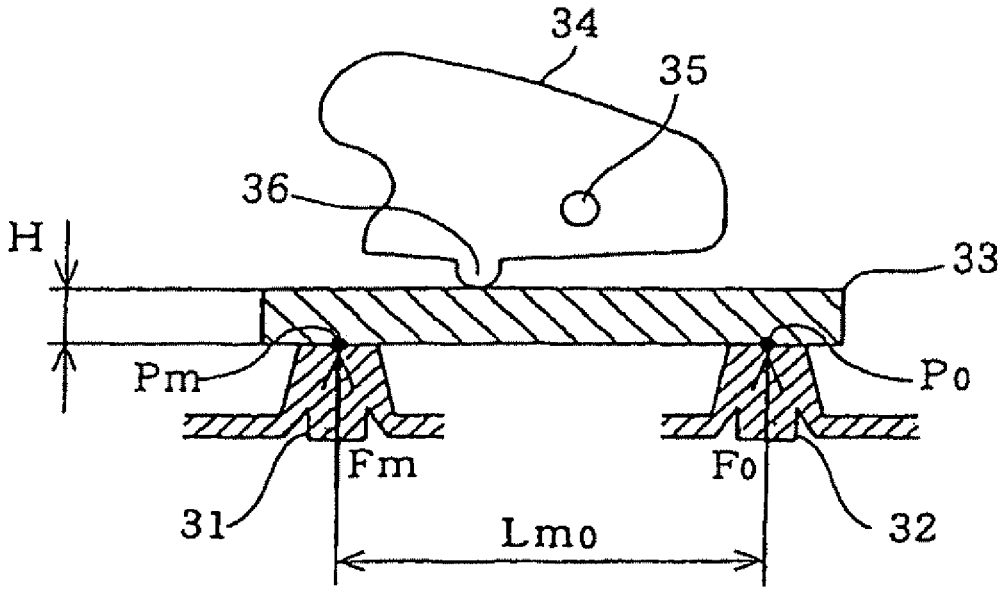
FIG. 6 is a view showing the switch device in the related art.

FIG. 5A shows a graph obtained by inputting the specific values in FIG. 5B to Expression (12). In FIG. 5A, the ratio '$H/L_{mo}$' of the distance $L_{mo}$ between the manual switch 10 and the automatic switch 14 to the height H of the pusher 16 is plotted with respect to the contact point load $F_m$ of the automatic switch 14. It can be understood from the graph that the contact point load $F_m$ decreases as the ratio '$H/L_{mo}$' increases, and the self-holding force $F_o$ (contact point load) of the automatic switch 14 marks a smaller value than the target value when '$H/L_{mo}$' is set as '0.9' as shown by a thick line. Meanwhile, the above specific values are extracted on the condition that the target operating force F for turning on the automatic switch 14 is set as '8.52 N'.

According to the embodiment, the following effects can be obtained.

Since the height H of the pusher 16 is set to be '0.9 times' or more of the distance $L_{mo}$ between the operating point $P_m$ of the manual switch 10 and the operating point $P_o$ of the automatic switch 14, the pusher 16 has a vertically long shape. Therefore, the operating force F of the knob 19 is influenced by the friction when the automatic switch 10 is pushed and turned on, consequently, the manual switch 10 and the automatic switch 14 can be pushed and turned on sequentially while using the automatic switch 14 having small self-holding force $F_o$.

The self-holding force $F_m$ of the manual switch 10 is set to have a relatively large value, and the self-holding force $F_o$ of the automatic switch 14 is set to have a relatively small value. Then, the distance between the operating point $P_s$ of the pusher 16 and the operating point $P_m$ of the manual switch 10 is set shorter than the distance between the operating point $P_s$ of the pusher 16 and the operating point $P_o$ of the automatic switch 14. Therefore, it is possible to strengthen the operating force that pushes and turns on the manual switch 10, and to weaken the operating force that pushes and turns on the automatic switch 14, consequently, both of the manual switch 10 and the automatic switch 14 can be operated with proper operating force.

According to the embodiment, even though the movable manual contact point 7 and the movable automatic contact point 11 are made of conductive rubber, the movable manual contact point 7 and the movable automatic contact point 11 are not limited thereto and may be made of non-conductive rubber. In this case, it is possible to mount conductive movable contactors on the contact point part 8 of the movable manual contact point 7 and the contact point part 12 of the movable automatic contact point 11.

The invention claimed is:

1. A switch device comprising:

a push-type manual switch that is to be pushed against self-holding force to an ON state, the self-holding force being set to have a relatively large value;

a push-type automatic switch that is to be pushed against the self-holding force to an ON state, the self-holding force being set to have a relatively small value smaller than the relatively large value;

a switch substrate that outputs manual signals for operating a power window of a vehicle to move as long as the manual switch remains in the ON state on the basis of the operation of the manual switch in the ON state, and outputs automatic signals for operating the power window to move to an allowable position on the basis of the operation of the automatic switch in the ON state;

a knob that can be operated by a user; and a pusher that pushes the manual switch and the automatic switch sequentially by operating force applied from the knob, wherein a height of the pusher is set to be 0.9 times or more of a distance between an operating point of pushing force exerted on the manual switch from the pusher and an operating point of pushing force exerted on the automatic switch from the pusher;

wherein a movable contact point of the push-type manual switch has a first contact point part and a first skirt part;

wherein a movable contact point of the push-type automatic switch has a second contact point part and a second skirt part;

wherein the second skirt part is thinner than the first skirt part; and wherein the relatively large value of the self-holding force of the push-type manual switch and the relatively small value of the self-holding force of the push-type automatic switch are determined by the respective thicknesses of the skirt parts of the push-type manual switch and the push-type automatic switch.

2. The switch device according to claim 1, wherein the knob transfers the operating force to the pusher at a location closer to the manual switch side with respect to a center point of a segment connecting the operating point of pushing force exerted on the manual switch from the pusher and the operating point of pushing force exerted on the automatic switch from the pusher.

3. The switch device according to claim 1, further comprising:

a holder base that is made of an elastic material and is provided on the switch substrate, wherein the first skirt part and the second skirt part are coupled to the holder base.

* * * * *